US005649676A

United States Patent [19]

Lord

[11] Patent Number: 5,649,676

[45] Date of Patent: Jul. 22, 1997

[54] PAPER ROLL TROUGH AND ENCLOSURE HAVING CHANNEL FOR WALL MOUNTING

[76] Inventor: Frederick Allan Lord, P.O. Box 399, Armstrong, B.C., Canada, V0E 1B0

[21] Appl. No.: 532,386

[22] Filed: Sep. 21, 1995

[30] Foreign Application Priority Data

Aug. 17, 1995 [CA] Canada ..... 2156321

[51] Int. Cl.[6] ..... B65H 16/02

[52] U.S. Cl. ..... 242/595

[58] Field of Search ..... 242/595, 594.1, 242/594.2, 132, 137; 312/242, 34.24, 34.8

[56] References Cited

U.S. PATENT DOCUMENTS

| | | | |
|---|---|---|---|
| D. 156,498 | 12/1949 | Fomusa et al. . | |
| D. 186,493 | 11/1959 | Sarro . | |
| D. 259,682 | 6/1981 | Standing . | |
| 1,436,990 | 11/1922 | Lillibridge . | |
| 1,745,771 | 2/1930 | Sherwood | 242/595 |
| 2,805,112 | 9/1957 | Krueger . | |
| 3,333,909 | 8/1967 | Beker | 312/242 X |
| 3,494,518 | 2/1970 | Goss . | |
| 3,930,697 | 1/1976 | Barouh et al. | 242/595 X |
| 5,104,054 | 4/1992 | Latham | 242/595 |

FOREIGN PATENT DOCUMENTS

| | | | |
|---|---|---|---|
| 300357 | 1/1989 | European Pat. Off. | 242/595 |

*Primary Examiner*—Daniel P. Stodola
*Assistant Examiner*—William A. Rivera
*Attorney, Agent, or Firm*—Bishop & Co.

[57] ABSTRACT

A paper roll holder has a paper roll enclosure for rigid partially embedded mounting of the paper roll enclosure into an aperture in a vertical wall, the aperture in a vertical wall defining an upper edge and opposed lower edge in the wall, a releasable cover for releasable mating onto an exposed front face of the paper roll enclosure, the paper roll enclosure having an opposed pair of generally vertical side walls, a lower trough extending laterally between the sidewalls for receiving a paper roll therein, the lower trough having a generally horizontal front lip extending laterally between the side walls, a channel extending downwardly from an undersurface of the lower trough for releasable mating of the channel over the lower edge in the wall, an upper mounting flange extending generally parallel to the channel and extending generally perpendicularly between, and generally upwardly from, the side walls, a rear wall extending upwardly and forwardly from a laterally extending rear-most extremity of the trough, the rear-most extremity of the trough opposed to the front lip, the rear wall extending between the side walls and having an upper edge rigidly connected to the upper mounting flange, the rear wall having a lateral aperture therein, generally parallel to the upper mounting flange, for receiving therethrough a backing plate, the backing plate releasably and generally vertically mountable to the rear wall through the lateral aperture, the upper edge in the wall clamped between the mounting flange and the backing plate.

7 Claims, 4 Drawing Sheets

PAPER ROLL TROUGH AND ENCLOSURE HAVING CHANNEL FOR WALL MOUNTING

FIELD OF THE INVENTION

This invention relates to the field of roll holders, and in particular, toilet paper roll holders which do not require spindles for suspending the paper roll.

BACKGROUND OF THE INVENTION

Many bathrooms, for example in residential houses, have a conventional style of paper roll holder of the type having a curved backing plate or surface rigidly mounted within a supporting frame generally flush with the bathroom wall and supporting an opposed pair of brackets extending outwards from the wall. Conventionally, a telescoping spindle may be mounted between the opposed pair of brackets so as to support a paper roll journalled on the spindle.

Conventional paper roll holders of this kind are not only aesthetically unappealing but also easily reached and tampered with by young children. Consequently, it is an object of the present invention to provide a spindleless paper roll holder which may be retrofitted to existing bathrooms to replace conventional paper roll holders. It is a further object of the present invention to provide a spindleless paper roll holder which has a cover which is easily removable by an adult but which may frustrate the attempts of a young child to play with the paper roll held in the spindleless paper roll holder beneath the removable cover.

In the prior art, the applicant is aware of U.S. Pat. No. 1,436,990 which issued to Lillibridge for a "Paper Container", on Nov. 28, 1922. It teaches a curved spindleless paper roll holder for supporting a paper roll in a smoothly curved lower cradle. The curved backing surface of the paper roll holder, as with conventional paper roll holders, is adapted to be partially encased by the wall of a bathroom. Vertically opposed external ribs or flanges are provided as means for determining the position to be occupied by the container when inserting the container in the wall so that the container may be built into the wall so as to encase the rear curved portion of the container in the wall.

Applicant is also aware of U.S. Design Pat. No. 156,498 was issued to Fomusa et al on Dec. 20, 1949 for a "Dispenser Or The Like". Like the Lillibridge patent, Fomusa also discloses what may be a spindleless paper roll holder. A cover is provided which is pivoted about the upper portion of the supporting frame. The frame would appear to be mountable on a bathroom wall. The pivotable cover is shaped so that, when closed, the curved backing surface and cover form generally the shape of a cylinder.

SUMMARY OF THE INVENTION

In one aspect, the roll holder of the present invention differs from conventional paper roll holders in that it has no spindle, bar or rod on which the paper roll is mounted and about which the paper roll rotates. Instead, the roll holder of the present invention relies on the smooth curvature of its lower cradle portion to retain a paper roll as it is rotated to feed paper from the roll and from the roll holder. The cradle portion provides a slight friction resistance to the rotation of a toilet roll in the cradle, which combined with the provision of a forward raised lip at the forward edge of the cradle, allows for sheets of toilet paper to be separated from the stream of toilet paper being unrolled from the paper roll.

In another aspect of the present invention, the aesthetically unappealing paper roll is hidden from view by provision of a removable cowl removably mountable onto the portion of the roll holder which extends outwards from the wall when the roll holder of the present invention is encased within a bathroom wall. The removably mountable cowl also provides protection for the paper roll from water, children and the like.

In another aspect of the present invention, the roll holder may be easily mounted, for example, by retrofitting into an existing bathroom, so as to be encased in a bathroom wall by means of a mounting plate extending upwards from an upper rear surface of the roll holder. Drywall or like sheeting material forming the bathroom wall may be inserted between the roll holder exterior frame and the mounting plate. Corresponding holes between the exterior frame and the mounting plate allow for screws or the like to be extended through the exterior frame, the drywall and then through the mounting plate so as to secure the roll holder in a recessed position within the bathroom wall.

Thus, in summary, the structure of the paper roll holder of the present invention has, a paper roll enclosure for rigid partially embedded mounting of the paper roll enclosure into an aperture in a vertical wall. The aperture in the vertical wall defines an upper edge and opposed lower edge in the wall. A releasable cover is provided for releasable mating onto an exposed front face of the paper roll enclosure. The paper roll enclosure has an opposed pair of generally vertical side walls, and a lower trough extending laterally between the sidewalls for receiving a paper roll, therein. The lower trough has a generally horizontal front lip extending laterally between the side walls, and channel extending downwardly from an undersurface of the lower trough for releasable mating of the channel over the lower edge in the wall. An upper mounting flange extends generally parallel to the channel and extends generally perpendicularly between, and generally upwardly from, the side walls. A rear wall extends upwardly and forwardly from a laterally extending rear most extremity of the trough, the rear most extremity of the trough opposed to the front lip. The rear wall extends between the side walls and has an upper edge rigidly connected to the upper mounting flange. A backing plate is generally vertically mounted to the rear wall and extends upwardly from the rear wall.

Advantageously, the channel has an opposed laterally extending pair of generally parallel channel walls wherein at least one of the walls is resilient and inclined inwardly towards the opposed channel wall to thereby resiliently clamp there-between the lower edge in the wall. Further, the backing plate may be resilient.

Further advantageously, the exposed front face of the paper roll enclosure may have a laterally opposed pair of exposed frontal areas on the side walls and mounted thereon means for releasable mating engagement with the releasable cover. The means for releasable mating engagement with the releasable cover may be an opposed pair of grooves on the opposed pair of forwardly exposed portions of the side walls for sliding engagement therein of a corresponding opposed pair of raised members on the releasable cover. In this embodiment, the opposed grooves and corresponding opposed raised members may be inclined in opposed parallel planes whereby the releasable cover when being releasably mated onto the exposed front face of the paper roll enclosure, is slid horizontally and downwardly so as to slide the opposed pair of raised members into sliding engagement within the opposed pair of grooves.

In one embodiment the mounting plate may be a separate member which is inserted through an elongated aperture extending from side to side across the top of the recessed portion of the roll holder. The aperture may be sized to provide a snug fit for the mounting plate, that is, to act as a guide for the mounting plate so as to align corresponding holes between the exterior frame and the mounting plate. In another embodiment, the mounting plate would be formed as a unitary piece with the recessed portion of the roll holder. In both embodiments, a channel extends from side to side across the bottom of the exterior frame with the channel opening in a downwards direction so that when installing the roll holder the channel may be placed over the lower edge of the drywall and the roll holder then pivoted upwards to insert the roll holder into the hole in the drywall.

DETAILED DESCRIPTION OF THE PREFERRED EMBODIMENTS

Figure 1:
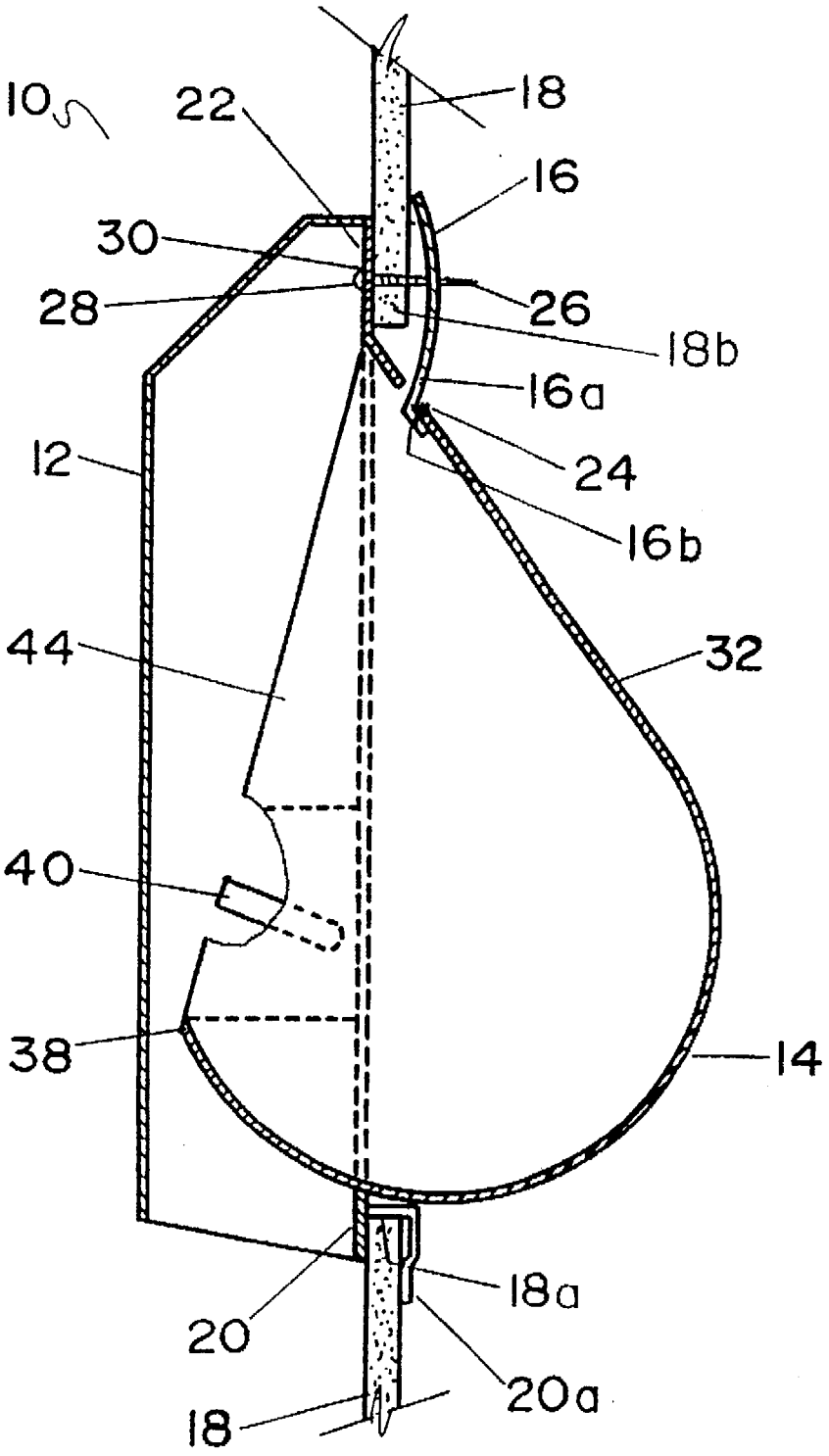
FIG. 1 is, in partial cut away cross sectional view, the paper roll holder of the present invention.
Figure 3:
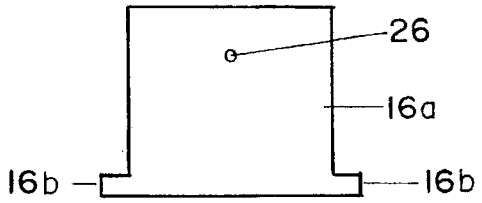
FIG. 3 is, in front elevation view, the mounting plate of FIG. 2.

As illustrated in FIG. 1, paper roll holder 10 has three components, namely, cover 12, roll enclosure 14, and mounting plate 16.

Figure 2:
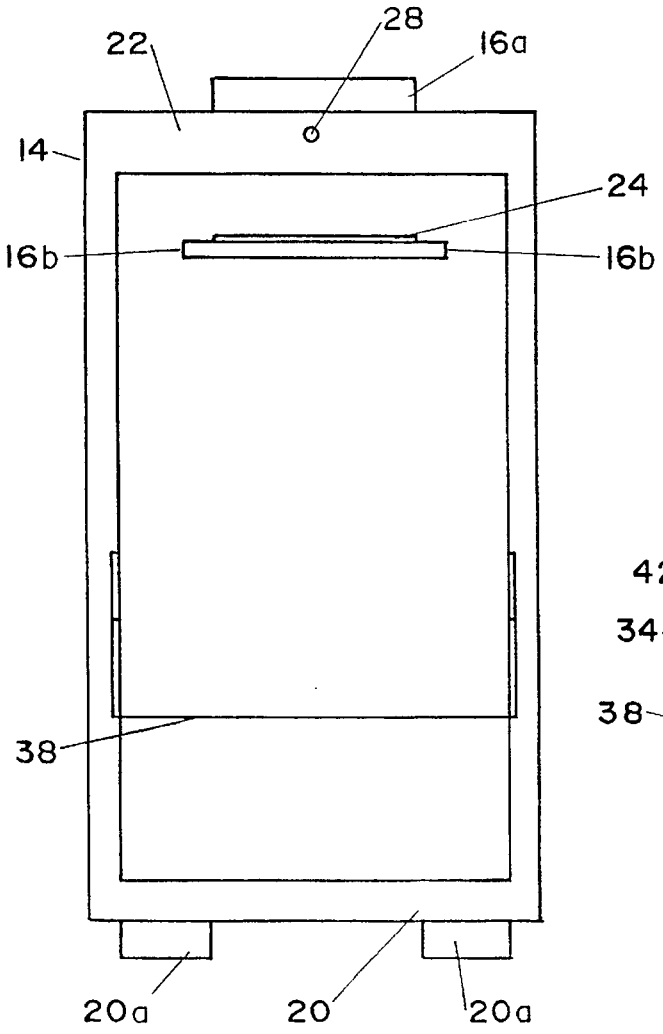
FIG. 2 is, in front elevation view, the roll enclosure and mounting plate of the paper roll holder of the present invention.

Roll enclosure 14 is mounted onto drywall 18 or the like by inserting roll enclosure 14 into an opening in the drywall so as to first clip lower resilient channel 20 over the lower edge 18*a* of the opening in drywall 18 and then rotating roll enclosure 14 to the vertical so as to place mounting flange 22 flush against the upper edge 18*b* of drywall 18. Mounting plate 16 may then be inserted upwards through lateral aperture 24, seen better in FIG. 2, so as to place mounting plate 16 against the rear surface of upper edge 18*b* of drywall 18. Thus, the position of mounting plate 16 against the drywall corresponds with the position of mounting flange 22 on the front face of upper edge 18*b*. Preferably, upper portion 16*a* of mounting plate 16 fits snugly within lateral aperture 24, at least along a lateral axis extending between the side walls of roll enclosure 14. Lateral aperture 24 thereby serves as a guide to alien mounting plate screwhole 26 in upper portion 16*a* of mounting plate 16, with screw 28 journalled in mounting flange screw hole 30. Mounting plate 16 has lower flanges 16*b* extending from upper portion 16*a* of mounting plate 16. Lower flanges 16*b* act to prevent mounting plate 16 being inadvertently pushed all the way through lateral aperture 24 thus preventing possible loss of mounting plate 16 behind drywall 18 during the installation of roll enclosure 14.

Figure 4:
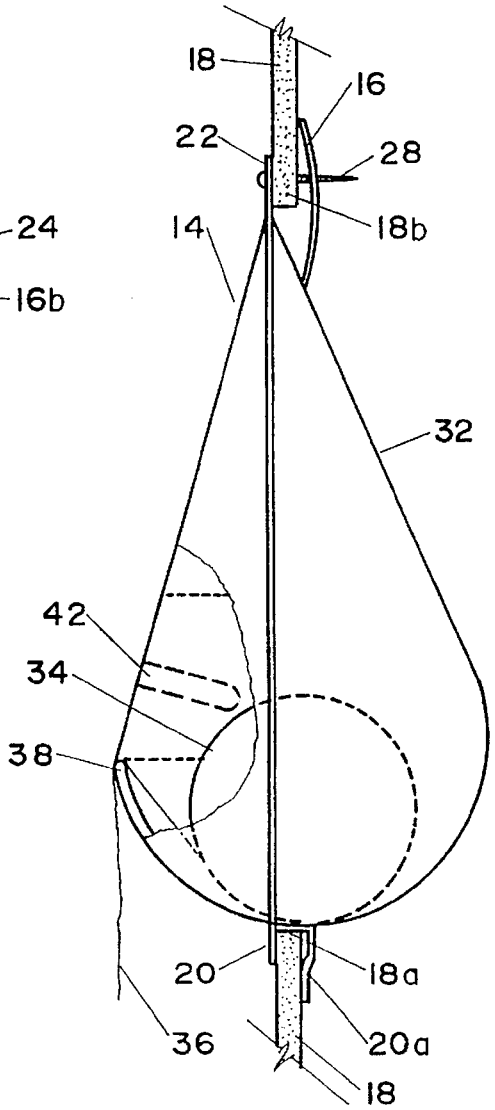
FIG. 4 is, in partial cut away side elevation view, an alternative embodiment of the paper roll holder of FIG. 1.

Mounting plate 16, and in particular upper portion 16*a*, may be concave as illustrated in FIGS. 1 and 4 so that if the material of which upper portion 16*a* is fabricated is somewhat resilient, then roll enclosure 14 may be more easily mounted on thicker supporting structures other than drywall 18, upper portion 16*a* of mounting plate 16 resiliently deforming by the action of screw 28 so as to conform to the back surface of drywall 18 or like supporting structure. Similarly, lower resilient channel 20 has resilient channel flange 20*a* for securely holding channel 20 in place on lower edge 18*a* when lower edge 18*a* is either of thinner or thicker or varying thickness along its length.

FIG. 4 illustrates an alternative embodiment in which mounting plate 16 is, instead of a separate member insertable into lateral aperture 24, resiliently mounted onto rear surface 32 of roll enclosure 14. Also illustrated is the manner in which a toilet roll 34 may be held within roll enclosure 14 so as to dispense sheets of toilet paper 36 over roll enclosure lip 38.

Figure 5A:
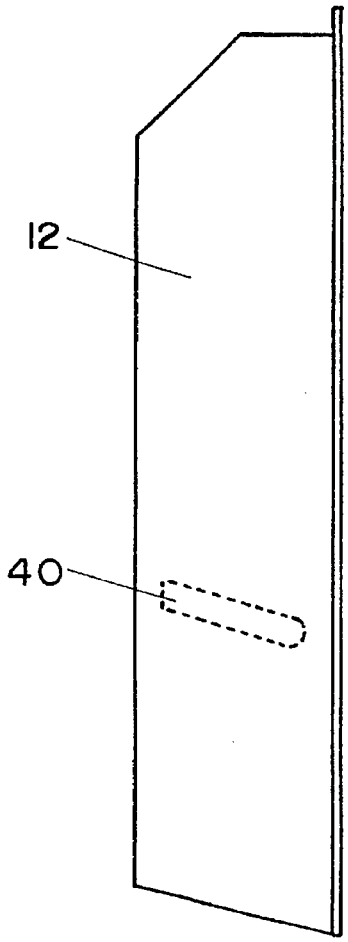
FIG. 5*a* is, in side elevation view, the cover of the paper roll holder of the present invention.
Figure 5B:
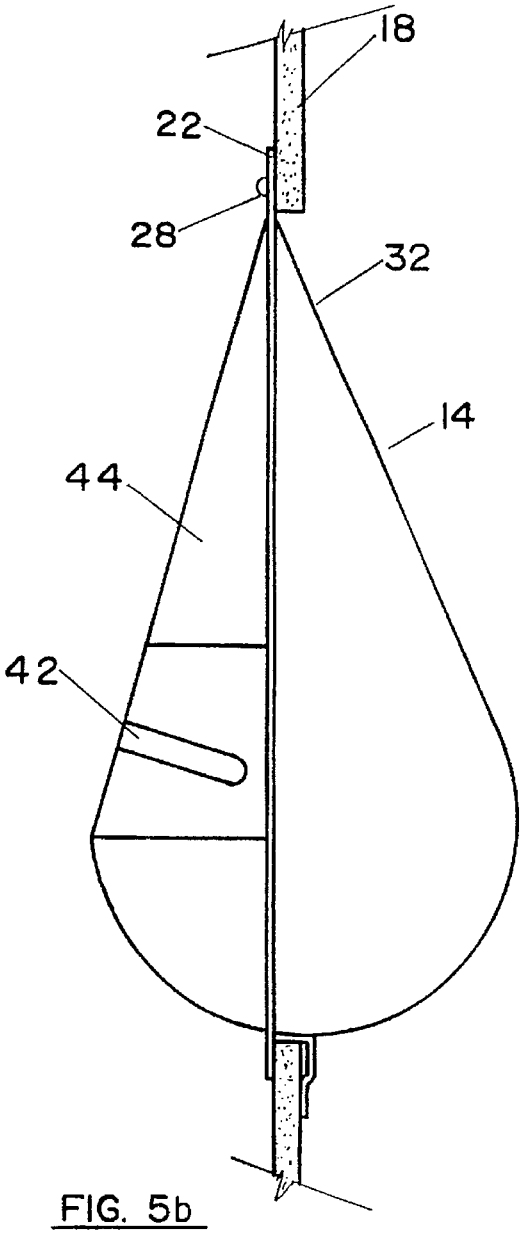
FIG. 5*b* is, in side elevation view, an alternative embodiment of the paper roll holder of FIG. 1.

In a further alternative embodiment illustrated in FIGS. 5*a* and 5*b*, roll enclosure 14 may be mounted onto drywall 18 or the like merely by directly affixing mounting flange 22 to upper edge 18*b* of drywall 18 by means of glue or other fastener means such as screw 28.

Figure 6:
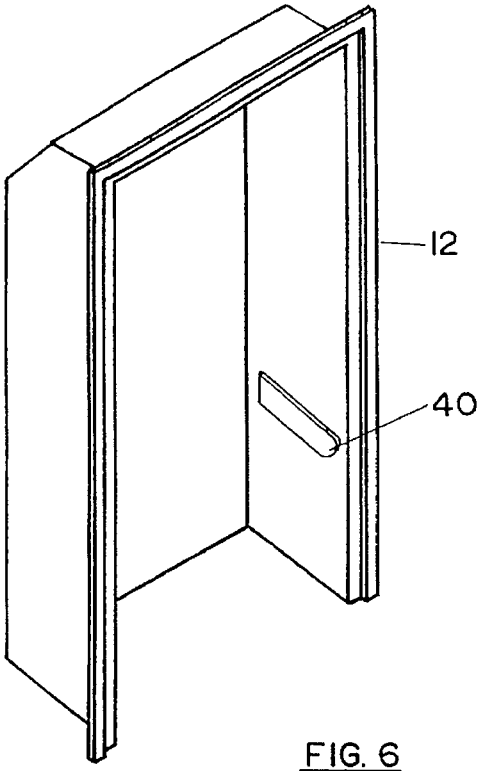
FIG. 6 is, in perspective view, the cover of the paper roll holder of the present invention.
Figure 7A:
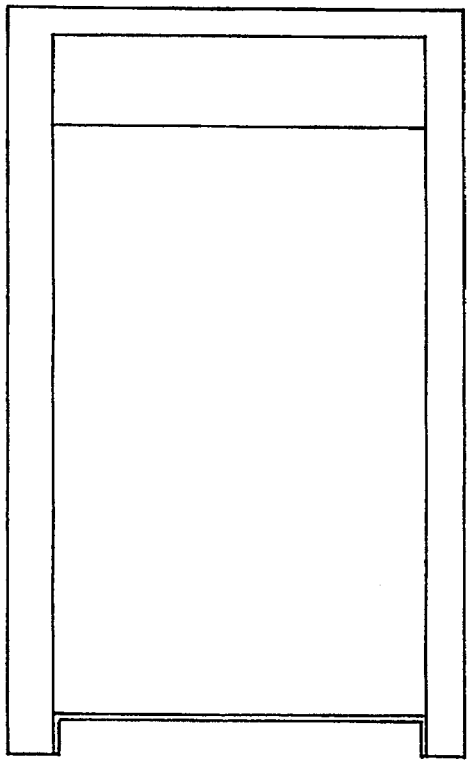
FIG. 7*a* is, in rear elevation view, the cover of FIG. 6.
Figure 7B:
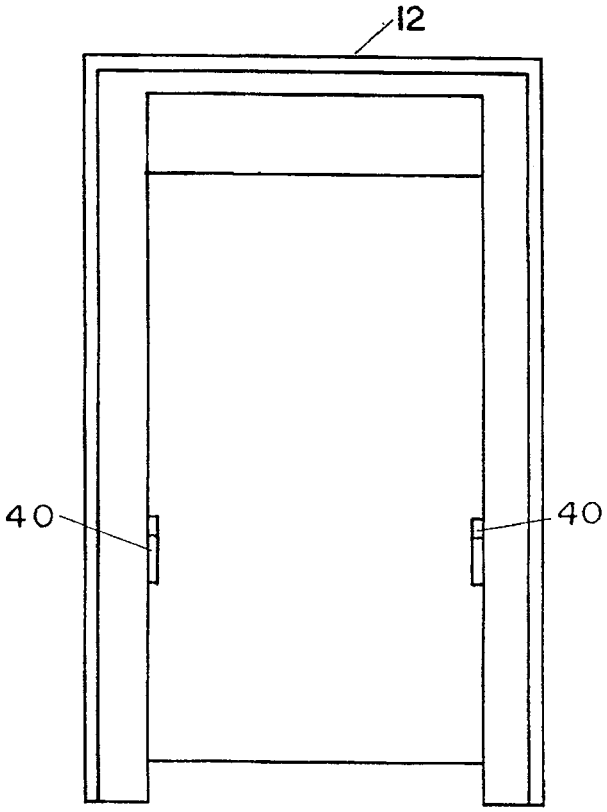
FIG. 7*b* is, in front elevation view, the cover of FIG. 6.

Cover 12, best seen in FIGS. 6 and 7*a* and 7*b*, is releasably mountable onto the front of roll enclosure 14. In one embodiment, a laterally opposed pair of raised members 40 on the laterally opposed interior surfaces of cover 12 mate by sliding engagement in corresponding laterally opposed grooves 42 on the forwardly extending surfaces 44 of roll enclosure 14.

It is understood that although cover 12 is depicted as a rectangular box-like shape, that cover 12 may be any aesthetically appealing shape so long as: (1) it is releasably mountable over the forwardly extending surfaces 44 of roll enclosure 14; and (2), it provides for the extraction of sheets of toilet paper 36 from below roll enclosure lip 38. Consequently, other forms of releasable mounting of cover 12 onto roll enclosure 14 are envisaged. In the embodiment depicted, raised members 40 and corresponding grooves 42 are upwardly inclined so that the weight of cover 12 assists in seating cover 12 firmly onto roll enclosure 14. Other forms of releasable mounting such as conventional Velcro releasable hook and loop fasteners or the like may be employed. The advantage of a mechanical stable™ mounting arrangement, such as depicted, is that cover 12 may be formed, for example, as having an upper surface which doubles as a decorative shelf for supporting other objects.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A paper roll holder comprising:

a paper roll enclosure for rigid partially embedded mounting of said paper roll enclosure into an aperture in a vertical wall, said aperture in a vertical wall defining an upper edge and opposed lower edge in said wall, a releasable cover for releasable mating onto an exposed front face of said paper roll enclosure, said paper roll enclosure having:

an opposed pair of generally vertical side walls, a lower trough extending laterally between said side walls for receiving a paper roll therein, said lower trough having a generally horizontal front lip extending laterally between said side walls, a channel means extending downwardly from an undersurface of said lower trough for releasable mating of said channel means over said lower edge in said wall, an upper mounting flange extending generally parallel to, in an opposed direction from, said channel means, and extending generally perpendicularly between, and generally upwardly from, said side walls, a rear wall extending upwardly and forwardly from a laterally extending rear most extremity of said trough, said rear most extremity of said trough opposed to said front lip, said rear wall extending between said side walls and having an upper edge rigidly connected to said upper mounting flange, said rear wall having a lateral aperture therein, generally parallel to said upper mounting flange, for receiving therethrough a backing plate, said backing plate releasably and generally vertically mounted to said rear wall through said lateral aperture, means for clamping said upper edge in said wall between said mounting flange and said backing plate.

2. A paper roll holder comprising, a paper roll enclosure for rigid partially embedded mounting of said paper roll enclosure into an aperture in a vertical wall, said aperture in a vertical wall defining an upper edge and opposed lower edge in said wall, a releasable cover for releasable mating onto an exposed front face of said paper roll enclosure, said paper roll enclosure having an opposed pair of generally vertical side walls, a lower trough extending laterally between said sidewalls for receiving a paper roll therein said lower trough having a generally horizontal front lip extending laterally between said side walls, a channel means extending downwardly from an undersurface of said lower trough for releasable mating of said channel means over said lower edge in said wall, an upper mounting flange extending generally parallel to, in an opposed direction from, said channel means, and extending generally perpendicularly between, and generally upwardly from, said side walls, said rear wall extending upwardly and forwardly from a laterally extending rear most extremity of said trough, said rear most extremity of said trough opposed to said front lip, said rear wall extending between said side walls and having an upper edge rigidly connected to said upper mounting flange, said backing plate generally vertically mounted to said rear wall and extending upwardly from said rear wall.

3. The device of claims 1 or 2 wherein said channel means comprises an opposed laterally extending pair of generally parallel channel walls wherein at least one of said walls is resilient and inclined inwardly towards the opposed channel wall to thereby resiliently clamp there between said lower edge in said wall.

4. The device of claim 3 wherein said backing plate is resilient.

5. The device of claim 4 wherein said exposed front face of said paper roll enclosure comprises a laterally opposed pair of exposed frontal areas on said side walls and mounted thereon means for releasable mating engagement with said releasable cover.

6. The device of claim 5 wherein said means for releasable mating engagement with said releasable cover comprises an opposed pair of grooves on said opposed pair of forwardly exposed portions of said side walls for sliding engagement therein of a corresponding opposed pair of raised members extending from said releasable cover.

7. The device of claim 6 wherein said opposed channels and corresponding opposed raised members are inclined in opposed parallel planes whereby said releasable cover, when being releasably mated onto said exposed front face of said paper roll enclosure, is slid horizontally and downwardly so as to slide said opposed pair of raised members into sliding engagement within said opposed pair of channels.

* * * * *